US007347252B2

(12) United States Patent
O'Connor, Jr.

(10) Patent No.: US 7,347,252 B2
(45) Date of Patent: Mar. 25, 2008

(54) CENTRIFUGAL IMPELLER

(75) Inventor: John F. O'Connor, Jr., New Hartford, CT (US)

(73) Assignee: The Bergquist Torrington Company, Torrington, CT (US)

( * ) Notice: Subject to any disclaimer, the term of this patent is extended or adjusted under 35 U.S.C. 154(b) by 162 days.

(21) Appl. No.: 10/978,228

(22) Filed: Oct. 28, 2004

(65) Prior Publication Data

US 2005/0103478 A1 May 19, 2005

Related U.S. Application Data

(63) Continuation of application No. 10/057,622, filed on Oct. 25, 2001, now abandoned.

(60) Provisional application No. 60/246,485, filed on Nov. 7, 2000.

(51) Int. Cl.
*F24H 3/02* (2006.01)
*F28F 7/00* (2006.01)

(52) U.S. Cl. ..... 165/121; 165/80.3

See application file for complete search history.

(58) Field of Classification Search ..... 165/121, 165/122, 125, 175, 80.3; 415/211.1, 211.2, 415/175, 176, 177, 178

(56) References Cited

U.S. PATENT DOCUMENTS

| | | | | |
|---|---|---|---|---|
| 4,362,468 | A * | 12/1982 | Nishikawa et al. | 416/186 R |
| 4,808,068 | A * | 2/1989 | Asbjornson et al. | 415/157 |
| 5,021,696 | A * | 6/1991 | Nelson | 310/62 |
| 5,707,209 | A * | 1/1998 | Iyer et al. | 416/186 R |
| 5,814,908 | A * | 9/1998 | Muszynski | 310/62 |
| 6,092,988 | A * | 7/2000 | Botros | 415/191 |
| 6,139,273 | A * | 10/2000 | Schwarz et al. | 416/185 |
| 6,244,331 | B1 * | 6/2001 | Budelman | 165/80.3 |

FOREIGN PATENT DOCUMENTS

GB 2342123 A * 4/2000

* cited by examiner

*Primary Examiner*—Tho Duong
(74) *Attorney, Agent, or Firm*—Haugen Law Firm PLLP

(57) ABSTRACT

An improved centrifugal impeller having between 20 and 26 rearwardly curved blades blades, a ratio of blade annulus width to wheel radius between 0.31 and 0.37, and an inlet blade angle in the range 32° to 36° and a discharge blade angle in the range 36° to 40°.

2 Claims, 3 Drawing Sheets

CENTRIFUGAL IMPELLER

CROSS-REFERENCE TO RELATED APPLICATIONS

This application is a continuation of U.S. Appl. Ser. No. 10/057,622, filed on Oct. 25, 2001 now abandoned, and entitled CENTRIFUGAL IMPELLER, which itself claims priority from U.S. provisional application Ser. No. 60/246,485, filed on Nov. 7, 2000 and entitled IMPELLER FOR ACTIVE HEAT SINK, the contents of which are incorporated herein in their entirety.

TECHNICAL FIELD

This invention relates to a centrifugal air impeller which may be used in a wide variety of air moving applications but which is particularly well suited to use in a compact low profile high efficiency heat sink system of the type disclosed in U.S. Pat. No. 6,244,331.

BACKGROUND

Requirements have become quite severe in the design of small high efficiency cooling systems for temperature critical electronic components. In a typical cooling system, air must be moved through a heat sink in a very small package size and with very low generation of noise. Axial fans have been employed in axially adjacent relationship with heat sinks but this is quite inefficient from a space standpoint. With axial fans imbedded in a heat sink performance is still found lacking. Unacceptable levels of noise generation and relatively large power requirements have been encountered.

More recent design approaches integrate the heat sink and drive motor into a single module with a relatively small size that is quite efficient. The cooling system may consist of a heat dissipating base plate directly adjacent to heat generating electronics or a heat pipe, and a multiplicity of small spaced apart heat dissipating elements mounted on the base plate and defining a multiplicity of small air flow passages therebetween. A centrally located cavity in the array of heat dissipating elements receives an electric motor which drives a centrifugal impeller disposed adjacent and about the array of heat dissipating elements. Cooling air is directed downwardly through an opening in an impeller backplate which is carried by the motor and is discharged radially after a right angle turn and passage through the heat dissipating elements.

To date these latter designs have employed centrifugal impellers with "forwardly curved" blades. Such impellers have relatively small blade annulus width to wheel radius ratio and this allows the design to maintain a small overall package diameter. However, the design also has significant disadvantages. First, the flow pattern in a forwardly curved impeller involves the recirculation of air through the blade passages and this is disrupted with an array of small heat dissipating elements placed radially within the impeller and adjacent the blades at their inlet ends. Severe losses in efficiency result. Further, with forwardly curved blades, the air at the discharge end of the blades is accelerated to velocities which are higher than the rotational velocity. This results in the need for a diffuser to convert velocity pressure to static pressure at the impeller discharge. Without such a diffuser or pressure conversion housing, these impellers are quite inefficient and may even be unstable. When a properly designed diffuser is associated with impellers with forwardly curved blades, the result is a package that is usually of excessive size in both radial and axial directions.

SUMMARY OF THE INVENTION

The present invention envisions a centrifugal impeller having "rearwardly curved blades" and resulting improved performance particularly when the impeller is used in the aforesaid heat sink assemblies. One reason for the efficient operation and improved size characteristics of centrifugal impellers with rearwardly inclined blades is the relative insensitivity of such impellers to objects placed in the their inlet flow paths. Thus, an impeller can readily accommodate the requirements of a heat sink in relation to the configuration of the flow path for cooling air, i.e. a multiplicity of heat dissipating elements in the inlet flow path. Further, the ratio of blade annulus width to impeller radius is larger than with a forwardly curved impeller but the rearwardly curved impeller has substantially less energy which leaves the blades in the form of velocity pressure. The conversion to static pressure occurs within the blade passages themselves. This allows the impeller to operate at a high level of efficiency without the use of external pressure conversion housings or diffusers.

As will be seen from the foregoing, a centrifugal impeller with rearwardly curved blades can truly be integral to a heat sink design. The impeller envelopes the array of heat dissipating elements and draws air axially through its own backplate and the air then turns 90° for passage through the spaces between the heat dissipating elements. Finally, the air is discharged radially. Since the array of heat dissipating elements occupies substantially all of the interior space of the centrifugal impeller, the geometry of the impeller is constrained by the dimensions of the former. The diameter at which the leading edge of the blades is located must closely match the diameter of the array of heat dissipating elements. Further, the axial inlet opening in the impeller backplate must be optimized for the efficient use of the heat dissipating elements and not necessarily for the highest degree of impeller efficiency.

Impeller efficiency is critical in order to provide the required air flow rate with minimal power input. This is necessary to keep the electric drive motor dimensions as compact as possible. The axial length of the motor must be minimized to maintain the low overall profile of the heat sink assembly and the motor diameter must be minimized since the motor is located within a central cavity in the array of heat dissipating elements and therefore affects the flow area and the maximum number of heat dissipating elements which can be employed.

The improved centrifugal impeller of the present invention with rearwardly curved blades employs specific geometrical relationships in combination in order to achieve the level of performance required within the constraints outlined above. Among such relationships are the ratio of the impeller inner radius to the impeller outside radius, the blade angles at the inlet and the discharge ends of the blades and the number of blades. These relationships will be set forth in greater detail hereinbelow. Peak static efficiency measured with the improved centrifugal impeller of the present invention is approximately 38% versus an approximate 5% range for conventional forward impellers and an approximate 18% range for other designs of impellers with rearwardly curved blades.

In the description and claims which follow, geometric and directional terms such as upright, upwardly, outwardly, downwardly etc. are employed for convenience of description only and are not to be taken as limiting the scope of the invention in any manner whatsoever.

DESCRIPTION OF THE PREFERRED EMBODIMENT

Figure 1:
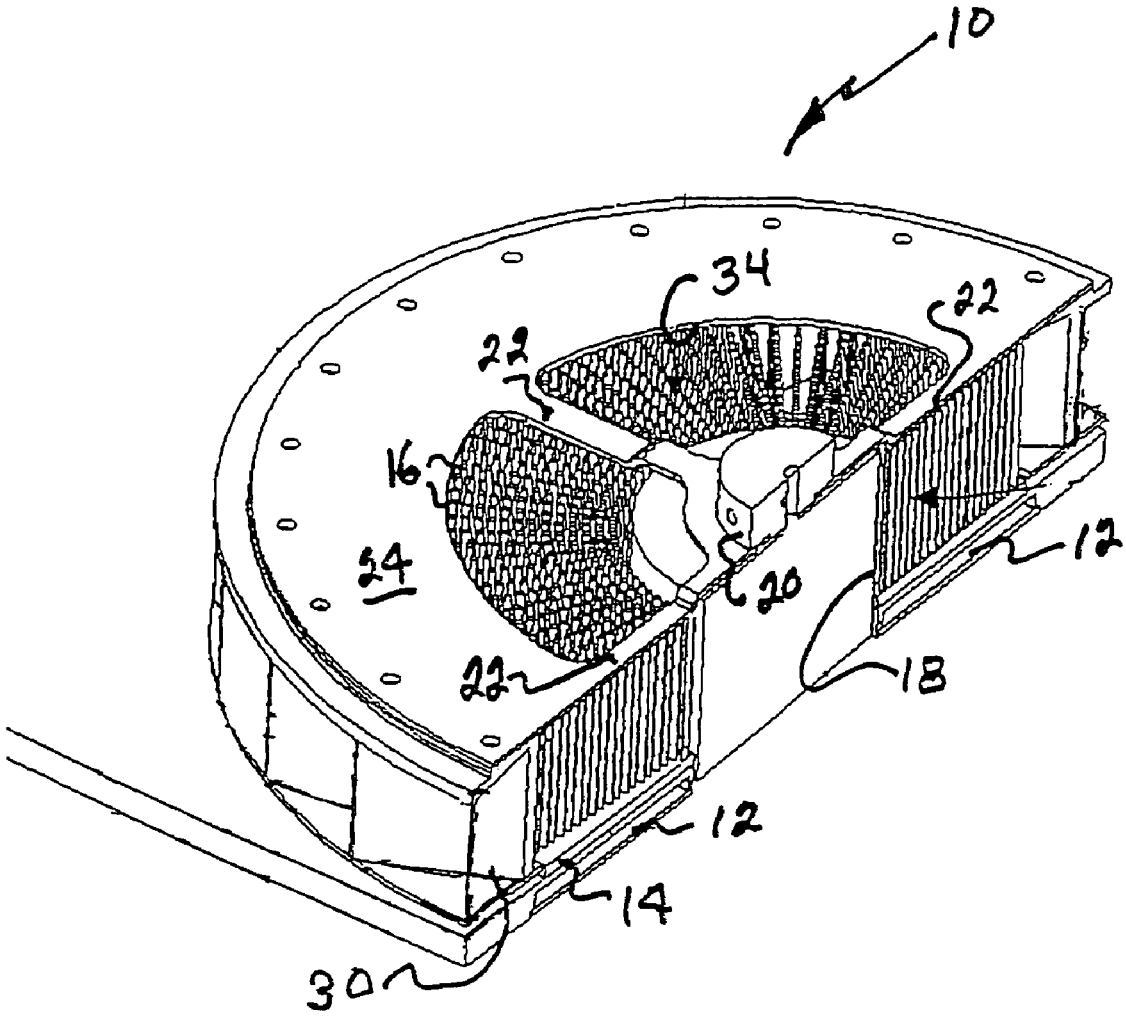
FIG. 1 is a fragmentary perspective view of an improved centrifugal impeller of the present invention incorporated in a heat sink, the front one half of the assembly being broken away for better illustration.
Figure 2:
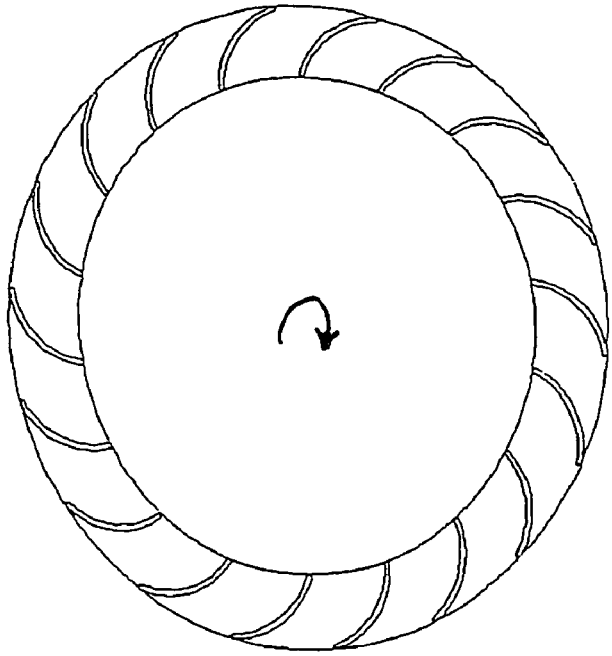
FIG 2 PRIOR ART
FIG. 2 is a schematic side view of a prior art centrifugal impeller with forwardly curved blades.

Referring initially to FIG. 1, a heat sink assembly including the improved centrifugal impeller of the present invention is indicated generally at 10. A thin rectangular "heat pipe" 12 conducts heated air from an electronic assembly to and beneath a baseplate 14 of the heat sink for cooling by the plate and an array of small heat dissipating elements 16, 16 mounted on the plate. The heat dissipating elements are shown as taking the form of small upright spaced apart metallic pins but may take a variety of other configurations including fins, panels etc. The array of pins defines a cylindrical central cavity 18 which receives an electric motor 20 for driving the impeller of the present invention. Circumaxially spaced spokes 22, 22 form part of a backplate 24 for the impeller and are connected with an output shaft of the motor 20 for rotation of the impeller. The impeller of the present invention has its blades open radially inwardly toward the pin array and discharges spent cooling air radially outwardly. As mentioned, central inlet opening 34 in backplate 24 directs cooling air axially downwardly into the heat dissipating pin field or array.

As will be apparent from the foregoing, cooling air is drawn axially downwardly through the inlet opening 34 in the backplate 24 of the impeller, flows throughout the pin array, impinges on the backplate, and thus is forced to make a 90° turn and flow radially outwardly to the impeller of the present invention. The impeller draws the cooling air from the pin array and discharges the same radially outwardly.

Figure 3:
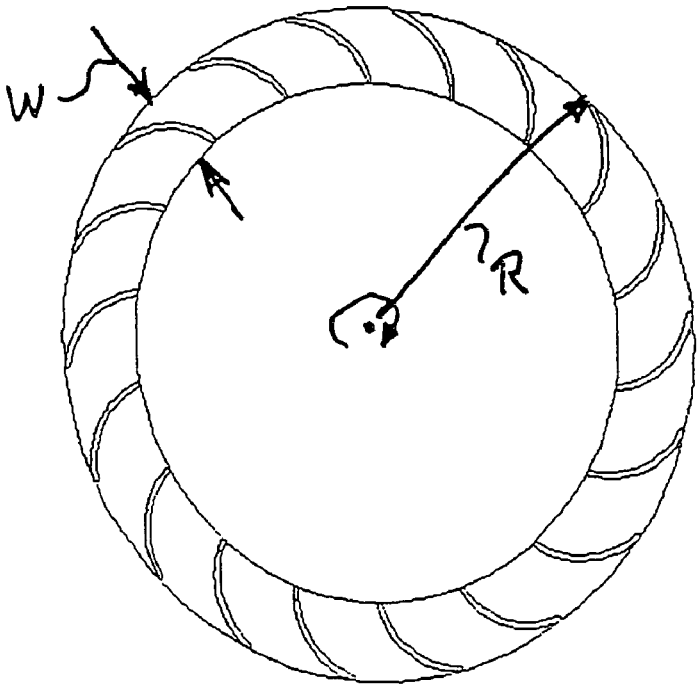
FIG. 3 is a schematic side view of an impeller constructed in accordance with the present invention and having rearwardly curved blades.

As mentioned above, detailed characteristics of the impeller are significant and result in high efficiency and substantially improved performance. Referring to FIG. 3, it will be noted that the blade annulus width dimension of the impeller is indicated at W and the impeller overall radius is indicated at R. In accordance with the invention, the ratio of W to overall wheel radius R should fall in the range of 0.25 to 0.5 and preferably in the more limited range of 0.31 to 0.37.

Figure 4:
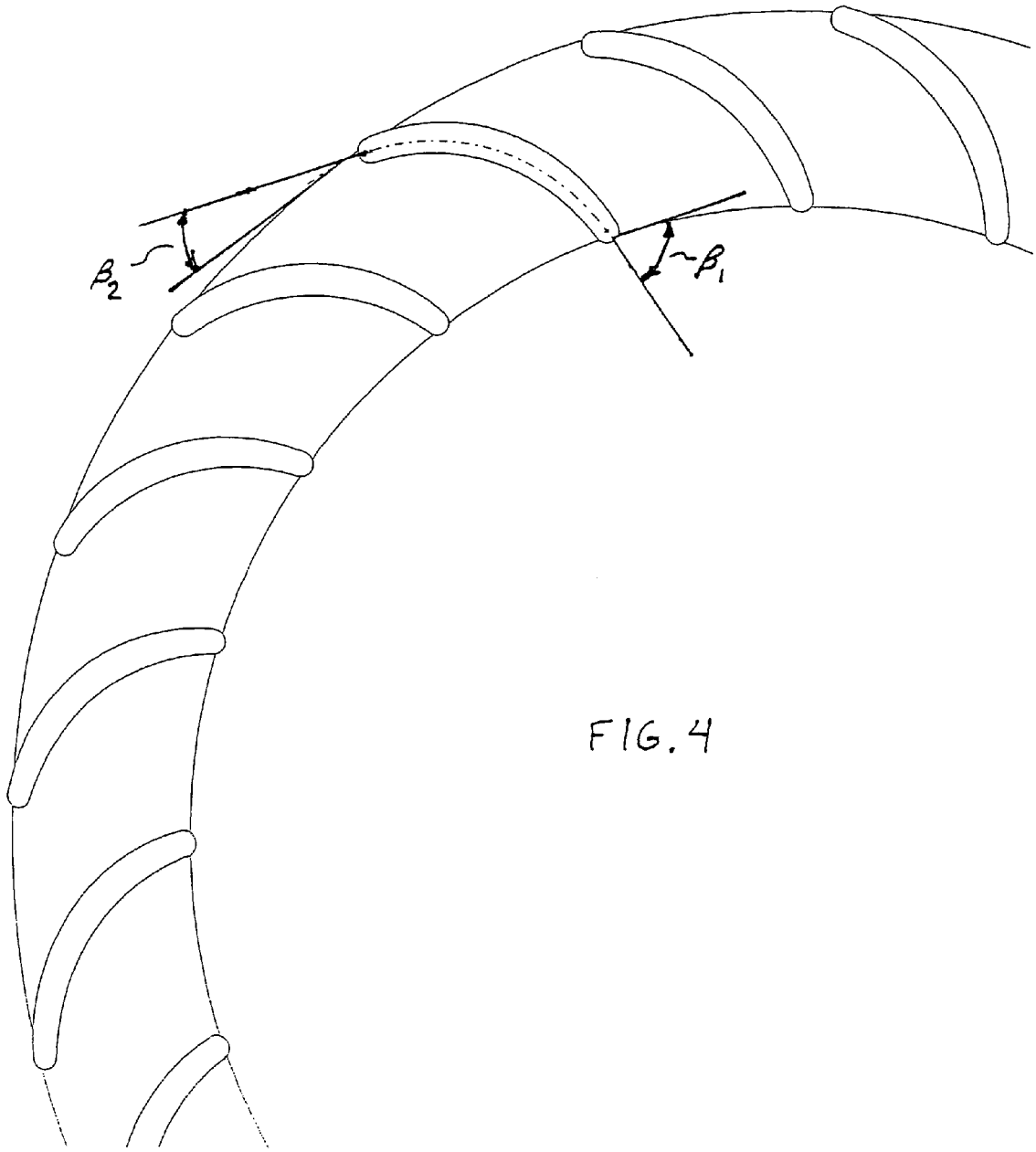
FIG. 4 is an enlarged fragmentary view of the impeller of FIG. 3 with the inlet and discharge angles illustrated.

Referring now to FIG. 4, a blade inlet angle $B_1$ is defined by a line tangent to a circle which intersects the inner edges of the blades and a line tangent to the centerline at the leading edge of each blade. The inlet blade angle $B_1$ should fall within the range 28° to 40° and preferably within the range 32° to 36°. Blade discharge angle $B_2$ is defined by a line tangent to the periphery of the impeller and a line tangent to the centerline at the trailing edge of the blades. The angle $B_2$ should fall in the range 32° to 44° and preferably in the range 36° to 40°.

Finally, the optimum number of blades for the improved centrifugal impeller of the present invention is believed to fall in the range 17 to 30 and preferably in the range 20 to 26.

The invention claimed is:

1. An improved centrifugal impeller for use in low profile heat sinks and the like having a multiplicity of small upright spaced apart heat dissipating elements in an array defining a multiplicity of small airflow passageways there between with a cavity located centrally there within, the impeller being adapted to be disposed adjacent to and about the array of heat dissipating elements and to be driven by an electric motor disposed in the central cavity, and the impeller being open radially inwardly for radial communication with the air flow passageways between the heat dissipating elements at least partially open radially outwardly for the discharge of spent air, the impeller also having a radially extending backplate which is exposed upwardly and which defines an inlet opening for the axial downward flow of cooling air, and a plurality of 20 to 26 rearwardly curved air moving blades forming a part of the impeller and serving to effect a right angle turn in air flow direction and to withdraw air radially outwardly through the passageways between the heat dissipating elements and direct the same radially outwardly, wherein the ratio of the radial dimension W measured between the leading and trailing edges of the blades to the overall radius R of the impeller falls in the 0.31 to 0.37, wherein the impeller blades each have an inlet angle in the range of 32 degrees to 36 degrees measured between a line tangent to a circle intersecting the inner blade edges and a line tangent to the blade centerline at its leading edge and a discharge angle in the range of 36 degrees to 40 degrees measured between a line tangent to the blade the impeller periphery and a line tangent to the blade centerline at its trailing edge.

2. An improved centrifugal impeller for use in low profile heat sinks and the like having a multiplicity of small upright spaced apart heat dissipating elements in an array defining a multiplicity of small airflow passageways there between with a cavity located centrally there within, the impeller being adapted to be disposed adjacent to and about the array of heat dissipating elements and to be driven by an electric motor disposed in the central cavity, and the impeller being open radially inwardly for radial communication with air flow passageways between the heat dissipating elements at least partially open radially outwardly for the discharge of spent air, the impeller also having a radially extending backplate which is exposed upwardly and which defines an inlet opening for the axial downward flow of cooling air, and a plurality of 17 to 30 rearwardly curved air moving blades forming a part of the impeller and serving to effect a right angle turn in air flow direction and to withdraw air radially outwardly through the passageways between the heat dissipating elements and direct the same radially outwardly, wherein the ratio of the radial dimension W measured between the leading and trailing edges of the blades to the overall radius R of the impeller falls in the 0.25 to 0.5, wherein the impeller blades each have an inlet angle in the range of 28 degrees to 40 degrees measured between a line tangent to a circle intersecting the inner blade edges and a line tangent to the blade centerline at it leading edge, and a discharge angle in the range of 32 degrees to 44 degrees measured between a line tangent to the blade the impeller periphery and a line tangent to the blade centerline at its trailing edge.

* * * * *